United States Patent [19]

Hoffman

[11] Patent Number: 5,044,123

[45] Date of Patent: Sep. 3, 1991

[54] CONCAVE-CONVEX FACETING METHOD AND APPARATUS

[76] Inventor: Douglas Hoffman, P.O. Box 400, Clayton, Wash. 99110-0400

[21] Appl. No.: 498,355

[22] Filed: Mar. 22, 1990

[51] Int. Cl.[5] ..... B24B 5/00; B24B 13/02

[52] U.S. Cl. ..... 51/73 R; 51/34 H; 51/45; 51/92 R; 51/98.5

[58] Field of Search ..... 51/73 R, 229, 283 R, 51/34 R, 34 H, 44, 45, 92 R, 98.5, 238 E, 34 C

[56] References Cited

U.S. PATENT DOCUMENTS

| | | | |
|---|---|---|---|
| 946,939 | 1/1910 | Gonard | 63/32 |
| 1,261,765 | 4/1918 | Challet | 51/229 |
| 1,262,217 | 4/1918 | Leperre | 51/229 |
| 1,277,377 | 9/1918 | Carter | 51/34 H |
| 2,107,921 | 2/1938 | Weed | 51/234 |
| 2,215,752 | 9/1940 | Enya | 51/98 |
| 2,663,976 | 12/1953 | Jacoby, Jr. | 51/92 |
| 2,745,225 | 5/1956 | Vonada | 51/206 |
| 3,135,073 | 6/1964 | Odle | 51/229 |
| 3,218,765 | 11/1965 | Volk | 51/73 |
| 3,312,118 | 4/1967 | Aubert | 74/424.8 |
| 3,364,629 | 1/1968 | Zalewski | 51/283 |
| 3,585,764 | 6/1971 | Huisman et al. | 51/283 |
| 3,797,177 | 3/1974 | Hoffman | 51/120 |
| 3,815,289 | 6/1974 | Hoffman | 51/125.5 |
| 3,981,105 | 9/1976 | Flaherty et al. | 51/71 |
| 3,992,821 | 11/1976 | Hoffman | 51/125 |
| 4,306,427 | 12/1981 | Urban . | |
| 4,308,727 | 1/1982 | Elbe . | |
| 4,558,538 | 12/1985 | Green . | |
| 4,686,795 | 8/1987 | Colliva . | |

FOREIGN PATENT DOCUMENTS

| | | | |
|---|---|---|---|
| 0016885 | 10/1980 | European Pat. Off. . | |
| 0002149 | 9/1917 | Netherlands | 51/229 |
| WO88/08357 | 11/1988 | PCT Int'l Appl. . | |

*Primary Examiner*—Robert A. Rose

*Attorney, Agent, or Firm*—Wells, St. John & Roberts

[57] ABSTRACT

An apparatus is described for producing concave or convex optically magnified facets about a gem, each facet being a curved surface that is a section of a cylinder. It utilizes a mandrel having an exterior and/or interior cylindrical abrasive surface. The surface is contacted by a gem indexed and adjustably held by a gem support structure. The mandrel is angularly movable about its central axis. It can also be reciprocated along the axis to prevent formation of random striations across the facet surfaces. An adjustable stabilizer can be preset to engage a dop attached to a gem at a location adjacent to the mandrel. This assures accurate reengagement of the gem after movement from the mandrel for interium inspections during the faceting precedure. The method of producing the optically magnified facets requires successive indexing of the gem and bringing it into contact with an angularly moving cylindrical abrasive surface. The resulting gem can have one or more curved facets about its outer surfaces having the form of a section of a cylinder. These facet surfaces can be either concave or convex. A preselected pattern of grooved facets can be produced across the curved facets by polishing then against a complementary moving mandrel surface.

15 Claims, 14 Drawing Sheets

Fig 11
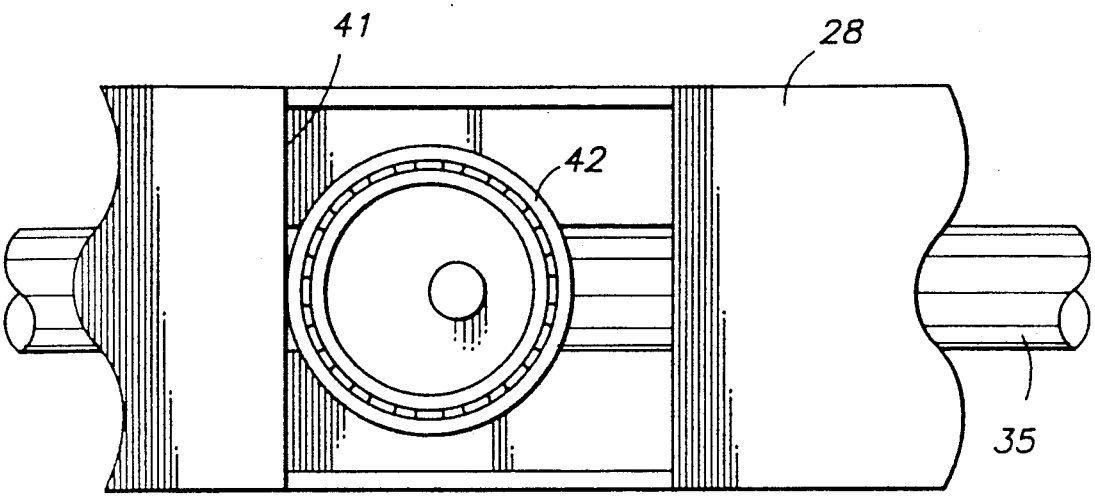
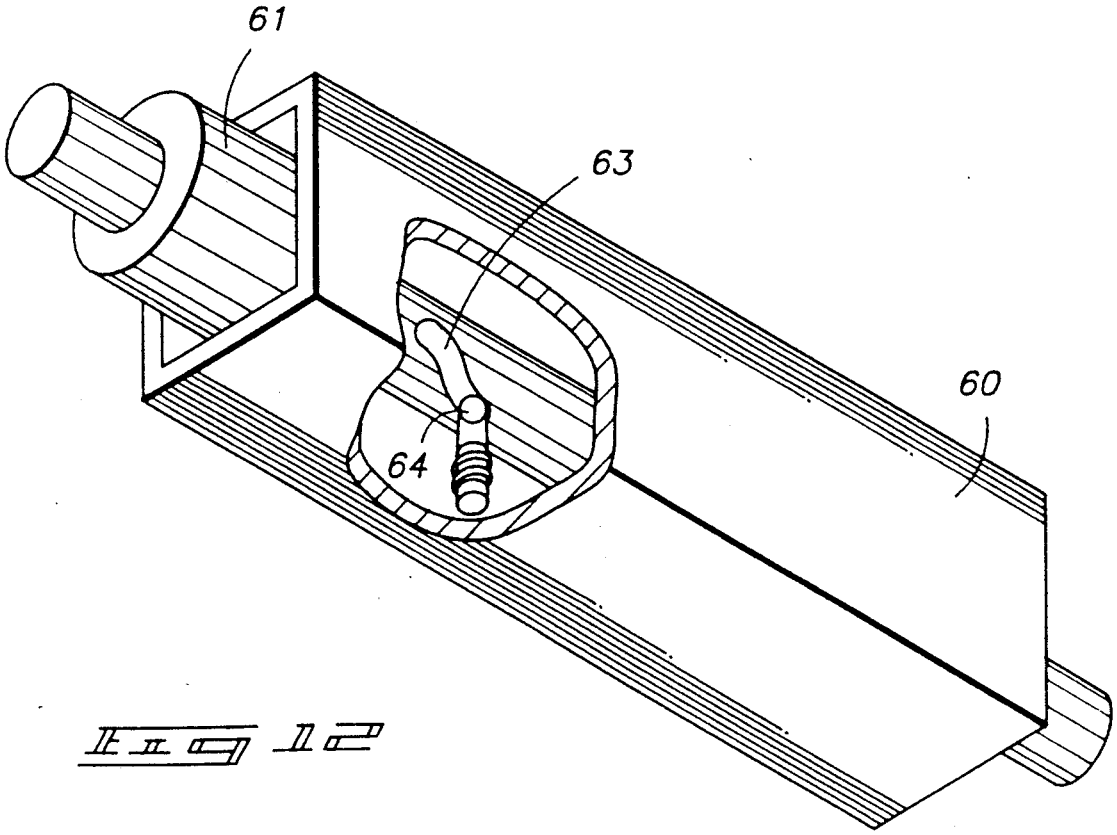
Fig 12

CONCAVE-CONVEX FACETING METHOD AND APPARATUS

TECHNICAL FIELD

This disclosure pertains to equipment and methods for producing optically magnified facets about a gem. It is also directed to the resulting faceted gems, which have all or some of their facets formed as curved surfaces that are sections of a cylinder.

BACKGROUND OF THE INVENTION

Conventional gem facets are smooth, flat, polished surfaces. The production of faceted gems typically involves cutting and polishing numerous angular facets about the exterior surface of the gem. They are normally arranged symmetrically about a central gem axis, although certain gems are faceted without regard for geometric symmetry. This produces an optical system of prisms and reflective surfaces that creates multiple visual virtual images of reflected light when viewed.

This invention arose from a discovery that the optical appearance of a faceted gem can be enhanced by producing facets having all or part of their surfaces in the form of curved surfaces that are sections of a cylinder. These unique facets, which shall be termed, "optically magnified facets", can be used in addition to or in place of all or some of the usual planar facets in any gem cutting pattern.

A spherical facet surface cannot be superimposed on a geometric facet pattern having straight facet sides without gaps about the edges of the curved surface. A curved surface that is a section of a cylinder has substantial straight line components that do not appreciably alter conventional gem faceting patterns. Cylindrically curved facets provide optical magnification in a gem without the substantial border areas that would be required if spherical "dimples" were formed about a gem.

The use of optically magnified facets increases the geometric variations available to a gem cutter beyond those possible when producing a gem by use of conventional flat facets. In addition, the optically magnified facets enhance the brilliance and scintillation of the gem. They also have been observed to intensify the color density of the gem in comparison to the natural crystal of a conventionally-faceted gem containing only flat facets. The recognized "fire" observable in diamonds is seen in less-precious gems of a lower refractive index having these uniquely curved facets. They also enhance the color dispersion of light reflected from the gem.

The apparatus and method disclosed herein have resulted in the production of an entirely new form of cut gems having optically magnified facets. The facets can be generated about individual cylinder axes that intersect the gem axis. They can cover all or part of the normal area of a conventional flat facet. The unique axial orientation of each optically magnified facet also permits the cylinder axes to be axially offset from the gem axis in a rotational progression about the gem axis, resulting in a helical pattern of facets not previously obtainable about a cut gem. Scintillation can be further enhanced by the production of reproducible grooved facets across the curved surfaces of the optically magnified facets.

BRIEF DESCRIPTION OF THE DRAWINGS

The preferred embodiment of the invention is illustrated in the accompanying drawings, in which:

FIG. 6 is a top view of the current mechanical embodiment of the invention;

FIG. 7 is a side elevation view from the right in FIG. 6;

FIG. 8 is a side elevation view from the left in FIG. 6;

FIG. 9 is an enlarged sectional view through the quill and mandrel assembly as seen along line 9—9 in FIG. 6;

FIG. 10 is a fragmentary sectional view taken along line 10—10 in FIG. 9;

FIG. 12 is a perspective view of the quill and mandrel shaft in FIG. 11;

DETAILED DESCRIPTION OF THE PREFERRED EMBODIMENTS

The following disclosure of the invention is submitted in furtherance with the constitutional purpose of the Patent Laws "to promote the progress of science and useful arts" (Article 1, Section 8).

Figure 1:
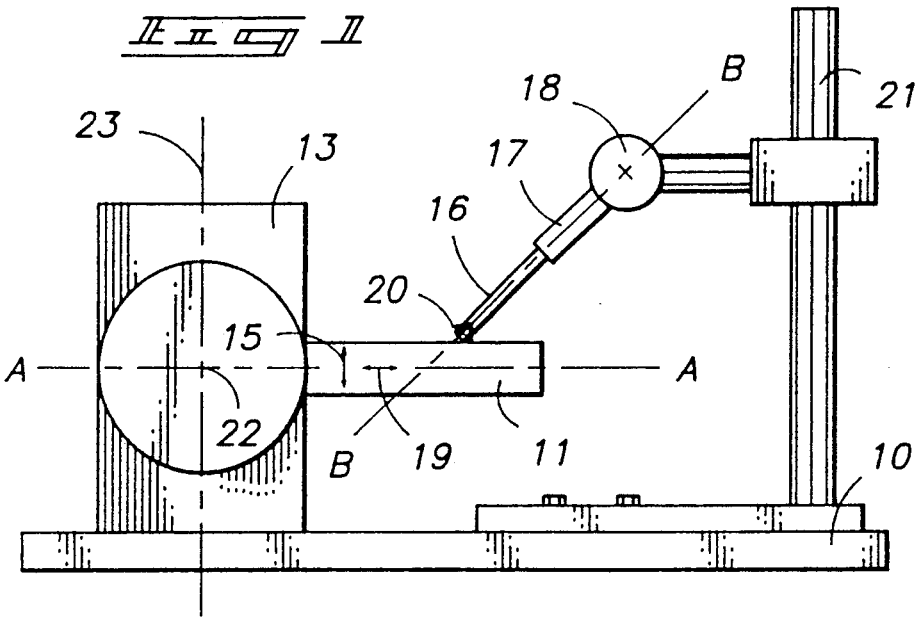
FIG. 1 is a diagrammatic elevation view of the basic elements of the disclosed apparatus for producing concave cylindrical facet surfaces.
Figure 2:
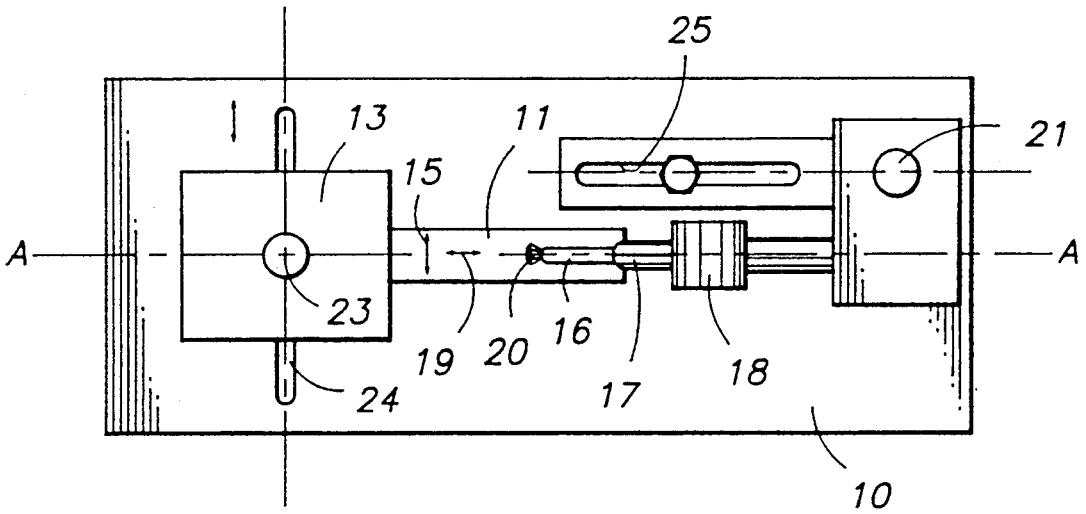
FIG. 2 is a diagrammatic plan view of the apparatus shown in FIG. 1.
Figure 3:
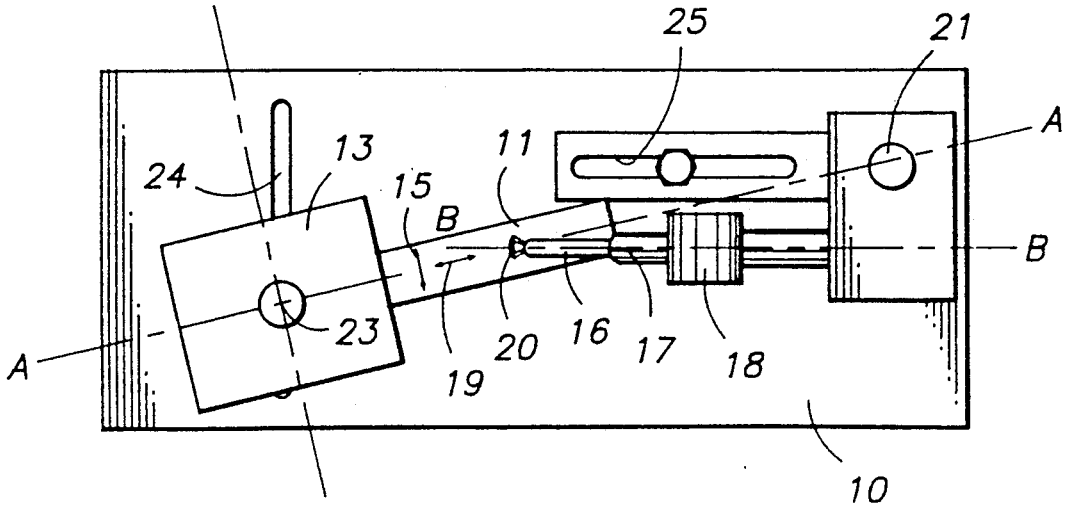
FIG. 3 is a diagrammatic plan view showing a different angular arrangement of the apparatus shown in FIG. 1.
Figure 4:
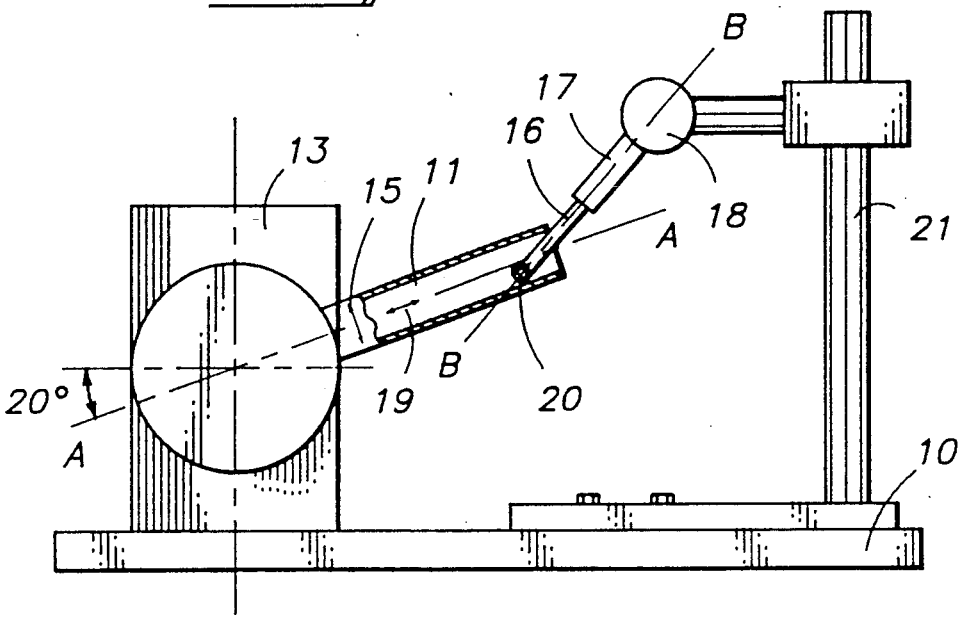
FIG. 4 is a diagrammatic elevation view illustrating use of the apparatus shown in FIG. 1 for production of convex cylindrical facet surfaces.
Figure 5:
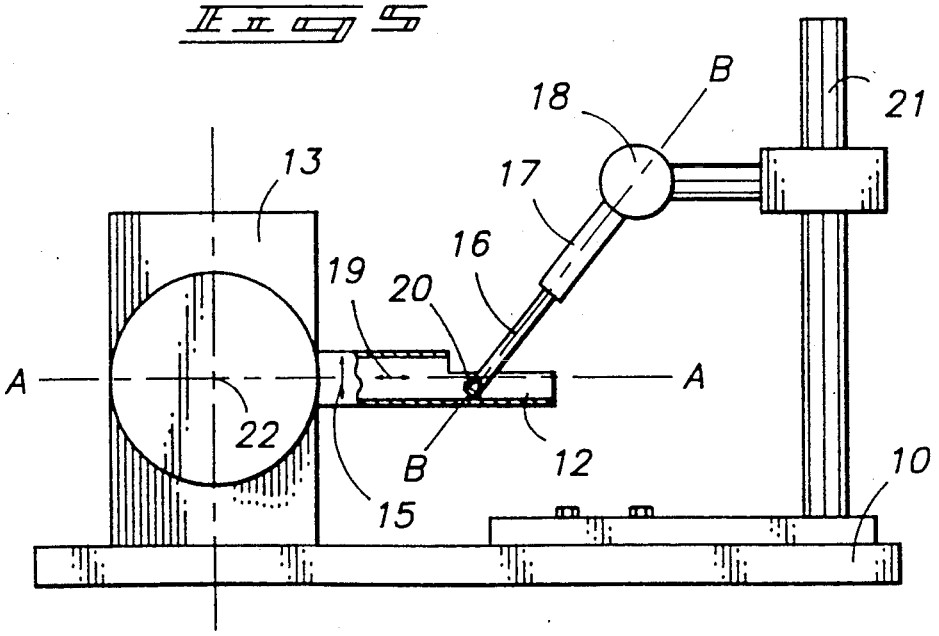
FIG. 5 is a diagrammatic elevation view of a modified apparatus for producing convex cylindrical facet surfaces.
Figure 5:
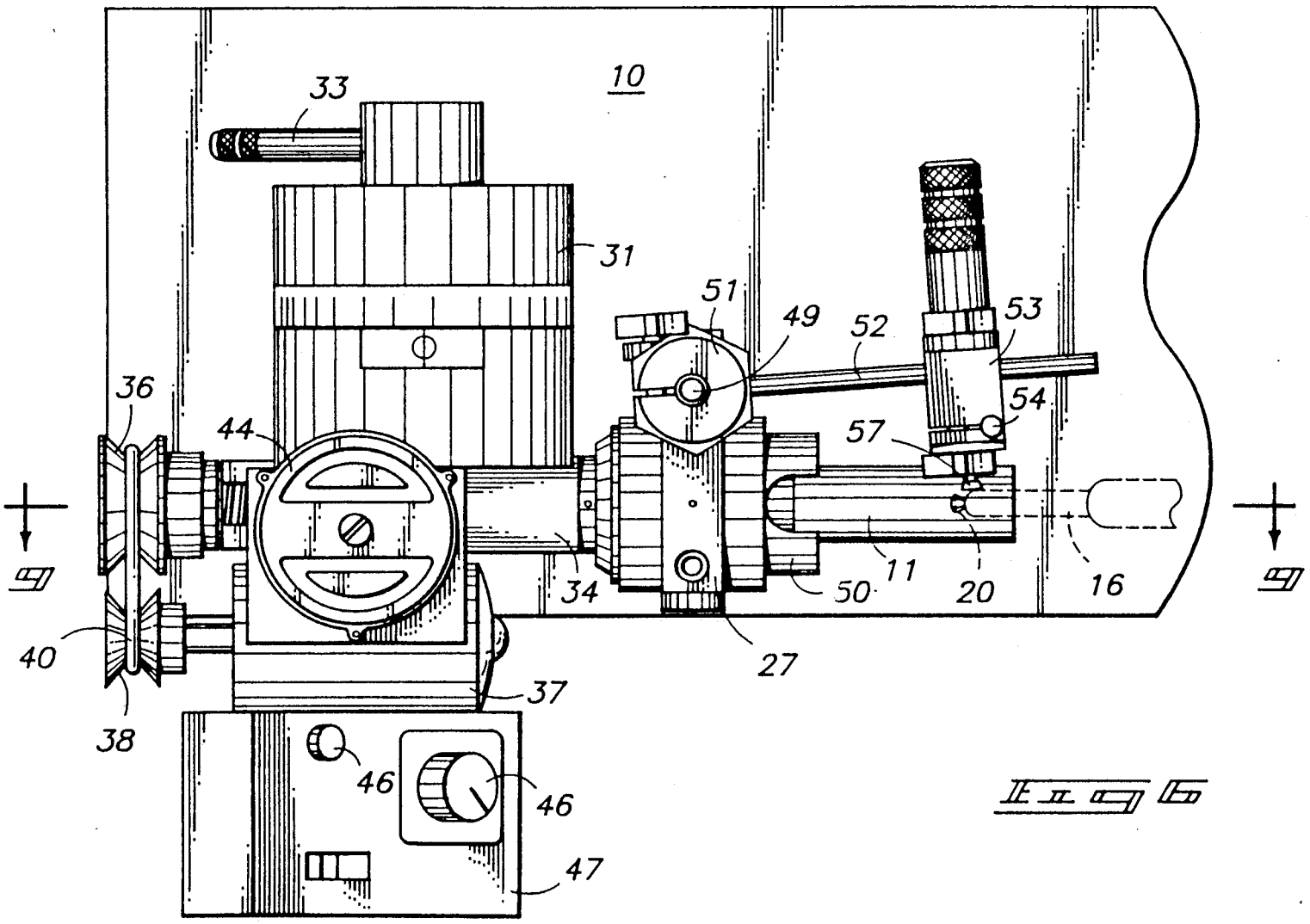

A first general form of the novel gem faceting apparatus is diagrammatically illustrated in FIGS. 1 through 4. FIGS. 1, 2 and 3 illustrate its use in the production of optically magnified facets formed as concave surfaces which are sections of a cylinder. FIG. 4 illustrates its use in the production of optically magnified facets formed as convex sections of a cylindrical surface. FIG. 5 illustrates use of a modified mandrel particularly adapted to the production of convex optically magnified facets.

As shown by arrows 15 in FIGS. 1-4, the mandrel 11 is angularly movable about its central axis. This movement is preferably continuous rotational movement. Alternatively, the mandrel can be continuously oscillated about its central axis. Mandrel 11 can also be simultaneously reciprocated parallel to its axis as shown by arrows 19. The dual motion (rotation and reciprocation) of the cutting and polishing mandrel surfaces assists in eliminating development of random surface striations that would otherwise detract from the highly polished facet surfaces.

All of the mandrels used for forming optically magnified facets according to this disclosure have operative cylindrical surfaces made from conventional materials used on facet laps. Cutting mandrels typically include a metallic surface, such as copper, which can be charged by addition of a conventional diamond paste which to impregnate the copper surface during cutting of a gem. Polishing mandrels are usually produced from a resin surface capable of supporting conventional polishing compounds.

The mandrel can be solid or can be hollow, with its outer end either open or closed. FIG. 4 illustrates use of a hollow mandrel 11 made from a cylindrical tube. Either or both of its exterior and interior cylindrical surfaces can be abrasive. Its outer end is open to permit mandrel 11 to be used in the production of convex optically magnified facets. The mandrel is preferably interchangeable on the unit 13 to permit substitution of alternate mandrels having different surface materials or surface configurations, as well as mandrels of different diameters.

Either the angular or reciprocating movement imparted to mandrel 11 can be the primary cutting or polishing movement, which requires greater surface speed than the transverse surface movement required to even the facet surfaces. If the facets are being produced primarily by rotary or pivotal angular movement of the mandrel 11 about its axis, the reciprocating movement imparted to it can be relatively slow. Conversely, if the facets are being produced primarily by the reciprocating movement, the rotary or pivotal angular movement about the axis can then be quite slow.

Dual motion of the mandrel is most vital to successful facet production during the cutting process, when formation of striations across a facet will usually occur. While dual movement of the mandrel is also desirable during polishing steps, this is not essential to production of smooth facet surfaces having the desired reflective and refractive qualities necessary in a gem. It is to be understood that angular movement or reciprocable movement of the mandrel can be used alone where this is practical in the production of a specific gem.

In the illustrated version of the apparatus shown in FIGS. 1-4, the cylindrical mandrel 11 is movably supported on a base 10. The mandrel 11 has inner and outer cylindrical surfaces centered about a reference mandrel axis designated by line A—A. Mandrel axis A—A can assume any desired spatial relationship about base 10. Its position will depend upon controlling geometry of the equipment and the desired faceting pattern.

A mandrel drive and support unit 13 is provided on base 10. It mounts and powers mandrel 11 angularly about axis A—A (as shown by arrow 15). It can also reciprocate it parallel to the same axis (as shown by arrow 19).

A gem 20 can be fixed to one end of a supporting dop 16 held by a dop arm 17. The dop arm 17 positions gem 20 along a dop axis B—B relative to base 10. The dop 16 and dop arm 17 are parts of a "gem holding means" on the base 10 that movably supports the gem 20 against the moving cylindrical abrasive surface of mandrel 11.

The mandrel drive and support unit 13 adjustably positions the mandrel 11 relative to base 10 about a transverse axis 22. This allows the mandrel axis A—A to be tilted from the horizontal, as illustrated in FIG. 4. Unit 13 is also pivotable about a vertical axis 23 on base 10 to offset the mandrel axis A—A relative to the dop axis B—B, as illustrated in FIG. 3. In addition, the unit 13 is transversely adjustable across the base 10 along a mounting slot 24 and the gem holding means is longitudinally adjustable along the base 10 by a slotted connection 25. These angular and translational adjustments can be used to universally vary the relative positions of a gem and the mandrel surface engaged by the gem to produce a desired facet.

In general, the "gem holding means" on base 10 will typically include a pivotally adjustable angle quadrant 18. The angle quadrant 18 can be pivoted about a horizontal axis to engage a preset stop (not shown) while engaging the moving cylindrical surface of the mandrel 11. By repeatedly indexing a gem 20 about the dop axis B—B, identical facets can by formed in a symmetrical pattern about the gem axis. Non-symmetrical facet patterns can be produced about a gem by individually setting the angular position of the dop about the dop axis B—B for each facet.

The angle quadrant 18 is elevationally adjustable on a vertical post 21 that extends upwardly from a movable support. The support and post 21 are preferably adjustable longitudinally along the base 10. Any suitable connection between the base 10 and support can be used for this purpose, such as the illustrated slot 25 as previously described. Post 21 is also be pivotable relative to base 10 about a vertical axis.

Further details concerning the "gem holding means" and its mounting to base 10 are not essential to an understanding of this invention. Examples of faceting equipment for adjustably holding gems are illustrated in U.S. Pat. Nos. 3,815,289 and 3,992,821, incorporated into this disclosure by reference.

FIG. 5 shows a second form of mandrel 12. Mandrel 12 is formed from a hollow tube, and has an interior cylindrical abrasive surface centered along the mandrel axis. The hollow tube forming mandrel 12 is partially split along the mandrel axis. This provides a greater degree of access to its interior cylindrical abrasive surface while producing a convex facet than is possible through the open transverse end of a cylinder as shown in FIG. 4. Mandrel 12 is angularly moved about the axis A—A in an oscillating motion. Mandrel 12 can also be used in the production of concave facets by turning the split section of the mandrel 180 degrees about the mandrel axis from the angular position shown in FIG. 5.

The exterior of the oscillating cylindrical surface would then be engaged by the gem being worked upon.

The method for producing the optically magnified facets comprises the steps of successively indexing a gem about a selected dop axis B—B and bringing the gem into engagement with the moving cylindrical surface of the mandrel. This will normally be carried out while simultaneously imparting angular movement to the cylindrical abrasive surface and relative reciprocating movement between the gem and abrasive surface. By imparting dual movement between the gem and mandrel in two intersecting directions, optically magnified facets are produced at selected positions about the gem without surface striations.

While it is helpful to first form planar facets about the gem before forming the concave or convex facet surfaces, this is not a requirement of the disclosed method. One can alternately produce the optically magnified facets in the initial formation and design of a gem. This is possible because of the ability to accurately position and reposition the gem relative to the mandrel axis, and because of the wide variations in angular positions that are possible between the gem axis and mandrel axis.

FIGS. 6–10 show a current embodiment of the invention. It is designed for use in conjunction with an existing gem support apparatus as described above. A common base 10 mounts both units in the manner generally illustrated in FIGS. 1–5.

A pedestal 30 supports the cylindrical mandrel 11. Pedestal 30 is pivotally supported on base 10 about vertical axis 23 (FIGS. 2 and 3). Handle 32 (FIG. 7) adjustably locks the pedestal 30 at a selected angular position about the vertical axis. A horizontal pivot structure 31 within the pedestal 30 also adjustably supports mandrel 11 about the horizontal axis 22 shown in FIGS. 1, 4 and 5. A second handle 33 is provided to manually lock the pivot structure 31 about the horizontal axis. Further details of pedestal 30 and pivot structure 31 are not believed to be necessary to an understanding of this invention.

A mounting slot 24 (FIGS. 2 and 3) or other mounting assembly can be provided to adjust pedestal 30 in transverse directions across base 10. A locking clamp (not shown) at the underside of base 10 positions pedestal 30 along the slot 24.

The pedestal 30 and pivot structure 31 support a quill guide 34 (see FIGS. 9 and 10.) The quill guide 34 slidably receives an elongated hollow quill 28 which can reciprocate longitudinally within it. Quill 28 in turn rotatably supports a mandrel shaft 35. An interchangeable mandrel 11 is mounted to one end of the mandrel shaft 35. A pair of spaced bearing assemblies 26 rotatably support mandrel shaft 35 within quill 28. Quill 28 and mandrel shaft 35 can move in unison along the mandrel axis as shaft 35 is rotated relative to the surrounding nonrotating quill 28.

The remaining end of mandrel shaft 35 carries a driven pulley 36. A motor 37 mounted to the exterior of quill guide 34 powers pulley 36 through a driving pulley 38 and interconnecting endless belt 40. The resulting flexible drive accommodates axial reciprocation of the mandrel shaft 35.

Reciprocation of quill 28 and mandrel shaft 35 along the mandrel axis is adjustably controlled by a motor 44 on the quill guide 34. A motor shaft extension 43 (FIG. 9) on motor 44 eccentrically drives the center race of a conventional ball bearing assembly 42 that serves as an eccentric cam engaged within a slot 41 at the top of quill 28 (FIG. 10).

Quill 28 is biased in one axial direction relative to quill guide 34 by a compression spring 48 that surrounds it (see FIG. 9). The spring 48 engages one end of quill guide 34 and an enlargement 39 adjacent to the pulley 36. It exerts a constant biasing force against quill 28 to maintain the opposed end of slot 41 in engagement with the bearing assembly 42. This eliminates relative movement between bearing assembly 42 and quill 28. It assures smooth constant reciprocation of mandrel shaft 35 in directions parallel to the mandrel axis as the eccentric bearing assembly 42 rotates about the vertical motor axis.

Separate speed control dials 46 located on a common motor control panel 47 fixed to the quill guide 34 independently control the motors 37 and 44. In this form of the invention, the circumferential surface speed of the mandrel will typically be substantially greater than its axial speed. The primary polishing of facet surfaces will be accomplished due to rotation of the mandrel 11. The slow reciprocation of mandrel 11 prevents creation of striations about the resulting facet surfaces.

A fixed shroud 50 partially overlaps mandrel 11 to minimize splashing of fluids and particles from the revolving mandrel surfaces. As can be seen in FIGS. 6 and 7, shroud 50 has a bracket 27 fixed across its upper surface. The bracket 27 carries a universally adjustable stabilizing assembly adapted to engage the dop 16 in a preset stationary position relative to base 10. Bracket 27 mounts a fixed post 49 offset laterally to one side of the mandrel axis. The stabilizing assembly includes an adjustable clamp 51 on post 49 that carries a shaft 52 arranged perpendicularly to post 49. Shaft 52 in turn carries a clamp 53 that can be adjusted angularly and longitudinally on shaft 52. An additional adjustable shaft 54 extends from bracket clamp 53 to a location adjacent the mandrel 11. It mounts a micro-adjustment unit 55 constructed similarly to a conventional micrometer.

A protruding threaded shaft 56 extends outwardly from the micro-adjustment unit 55 and terminates at an enlarged abutment 57. Abutment 57 engages the dop 16 holding a gem 20 during a faceting operation. The micro-adjustment unit 55 can be adjusted angularly about three perpendicular axes and axially along two of the axes. The universal range of adjustment is used to accurately position abutment 57 against a dop at a location directly adjacent to the operational surface of mandrel 11.

Precise engagement between a dop and the abutment 57 is assured by the fine adjustment provided through the micro-adjustment unit 55. In this manner, a fixed reference surface is provided to abut the dop. It can remain in a stationary preset condition during a faceting operation. One can therefore lift the dop from the mandrel 11, swing the dop and an attached gem 20 to a suitable inspection position, and subsequently reengage the gem 20 against mandrel 11 with assurance that a selected gem facet is accurately repositioned against the cylindrical mandrel surface.

Figure 11:
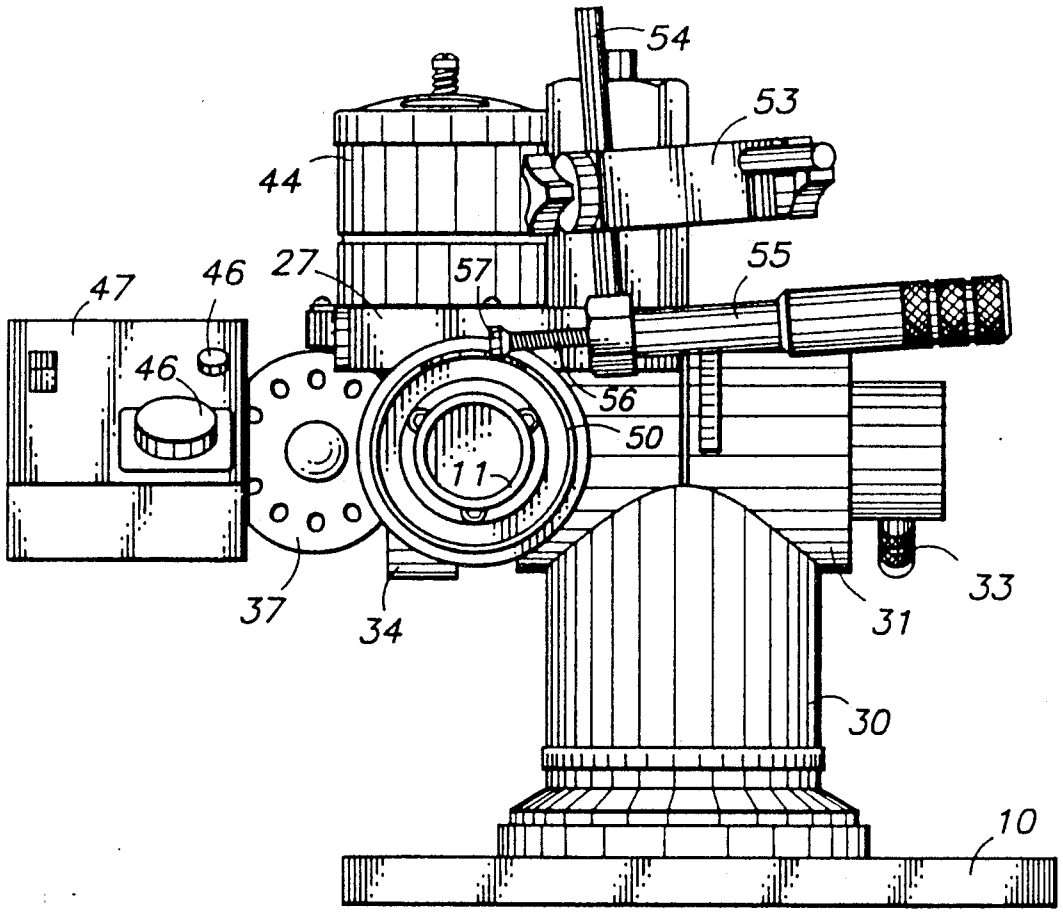
FIG. 11 is a view similar to FIG. 6, showing an alternate quill and mandrel assembly.
Figure 11:
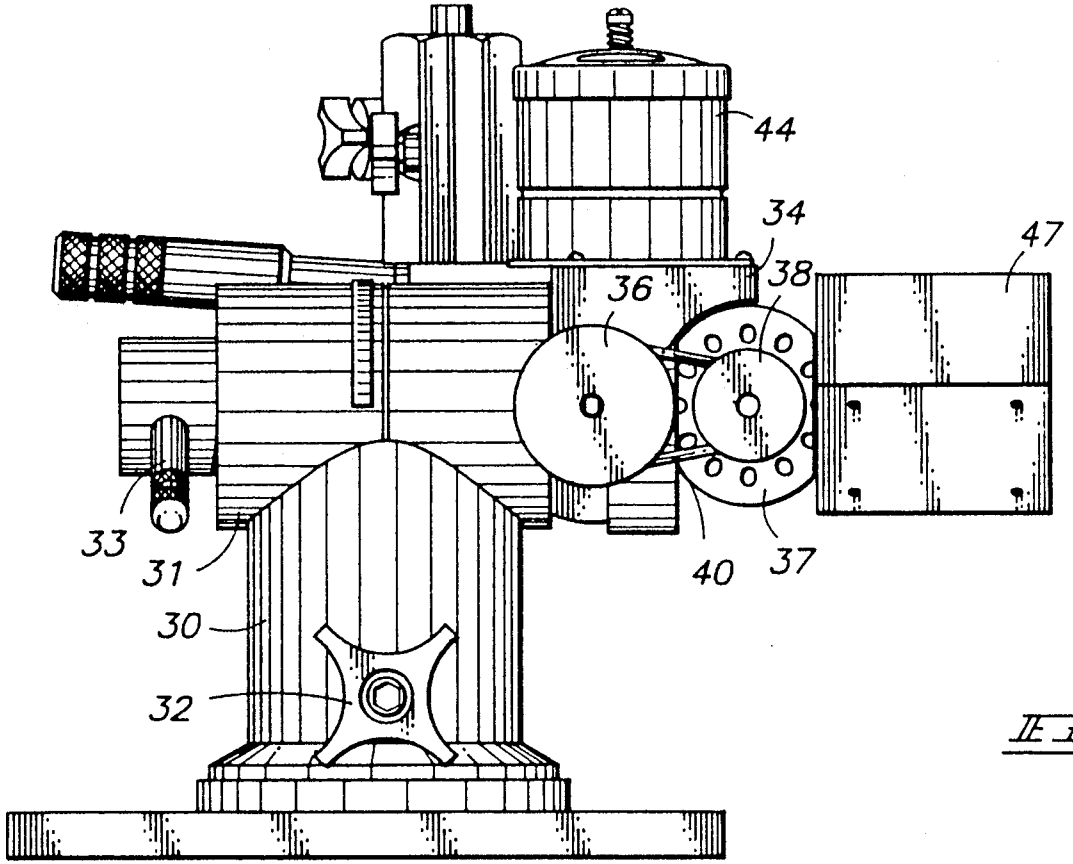
Figure 5:
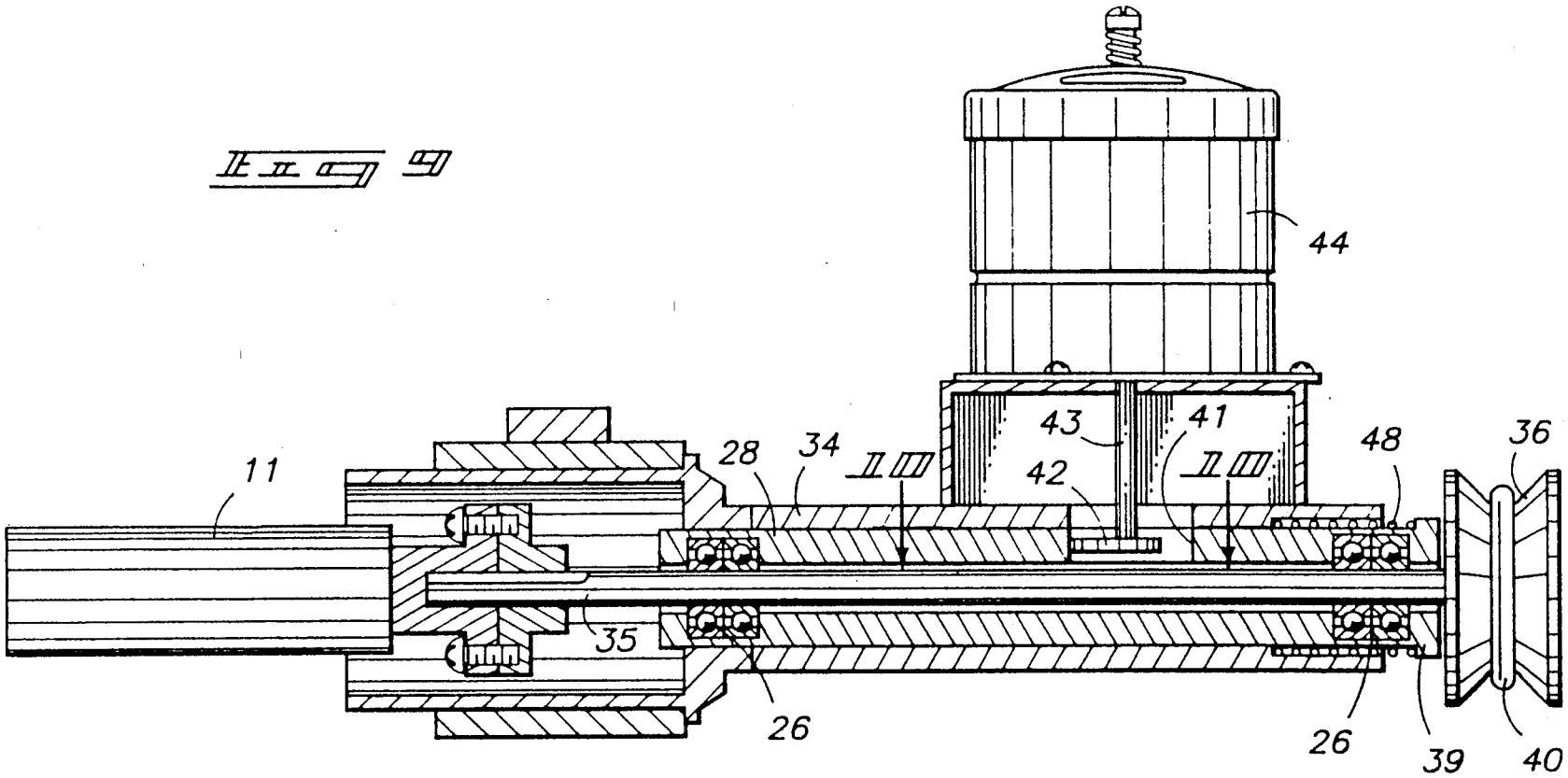
Figure 11:
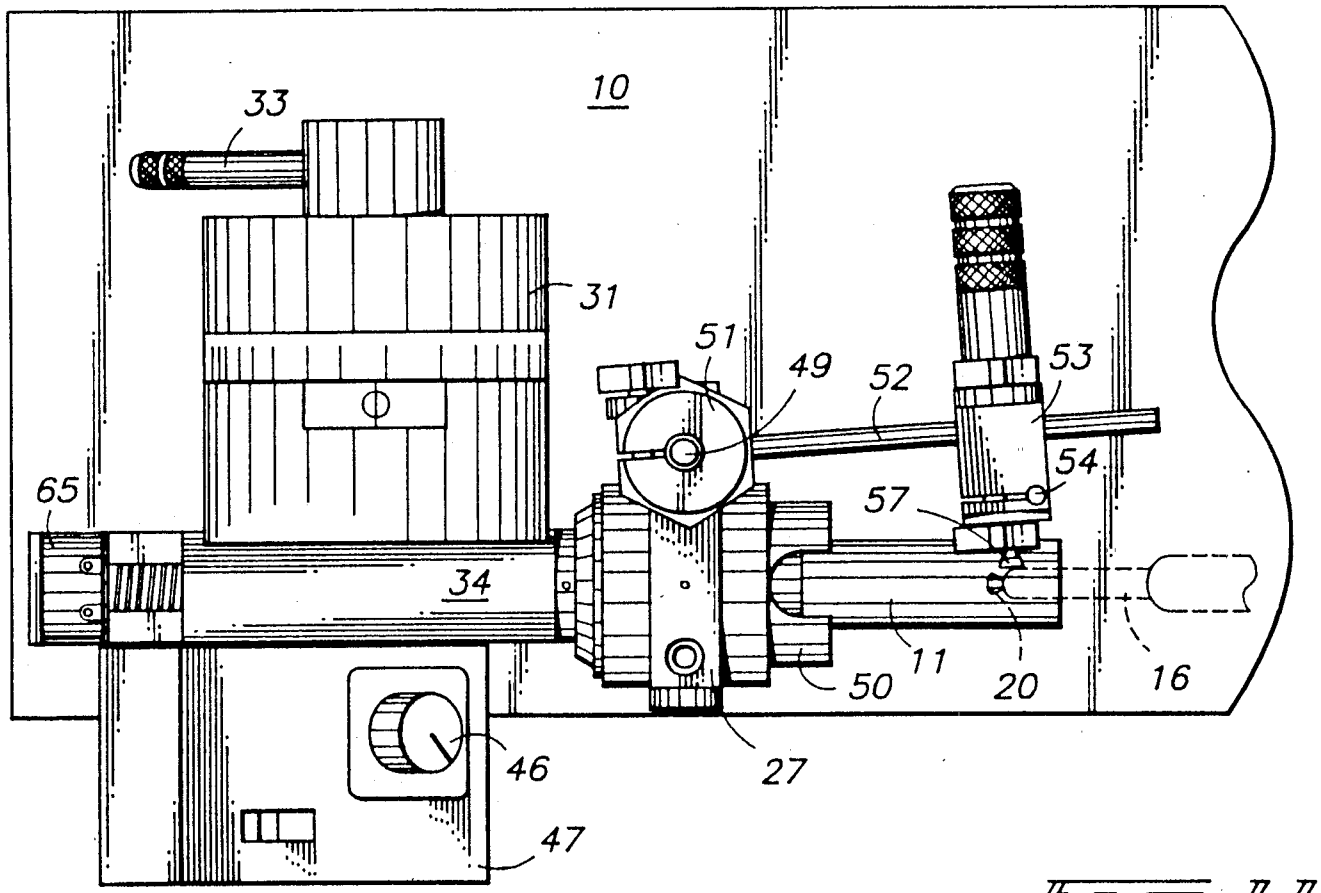

FIGS. 11 and 12 show an alternate quill and shaft assembly. In this embodiment, the receiving quill guide 34 clamps the quill 60 in a stationary position. The interior of quill 60 rotatably supports mandrel shaft 61 by means of spaced bearings (not shown) that permit both longitudinal and rotational movement of shaft 61 relative to the surrounding quill 60.

The outer surface of shaft 61 within quill 60 is provided with a helical groove 63 that receives a stationary ball 64 positioned within the bottom of quill guide 34. Reciprocation of the shaft 61 along its axis will therefore cause quill 60 to be rocked or oscillated about the mandrel axis due to the interengagement between ball 64 and groove 63. The rocking action will be reversed as a function of reversing reciprocating movement.

A vibratory motor 65 or other suitable linear transducer is connected to the outer end of shaft 61 to impart reciprocating motion to it. In this instance, the reciprocating movement imparted to shaft 61 and mandrel 12 will produce the primary cutting and polishing action on the surfaces of mandrel 12. It will be rocked back and forth at a slower surface speed to prevent formation of surface striations.

It is to be understood that the specific mechanisms illustrated in FIGS. 6–12 are only exemplary. The illustrated designs are subject to substitution of alternate mechanisms and driving devices capable of imparting desired combinations of rotational, oscillating and reciprocating movement to the mandrel.

Figure 18:
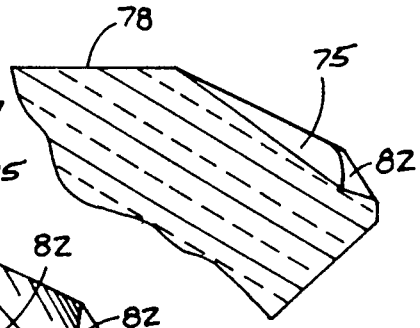
FIG. 18 is a sectional view taken along line 18—18 in FIG. 16.
Figure 19:
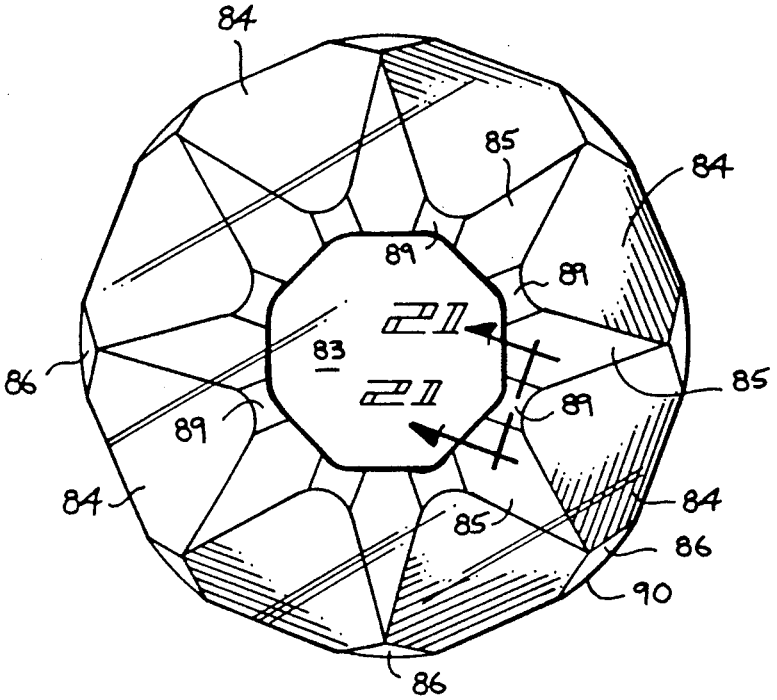
FIG. 19 is a top view of a brilliant cut gem having convex facet surfaces about its crown.
Figure 21:
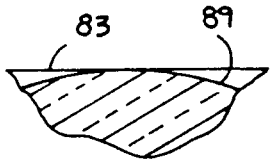
FIG. 21 is a sectional view taken along line 21—21 in FIG. 19; about its crown.
Figure 20:
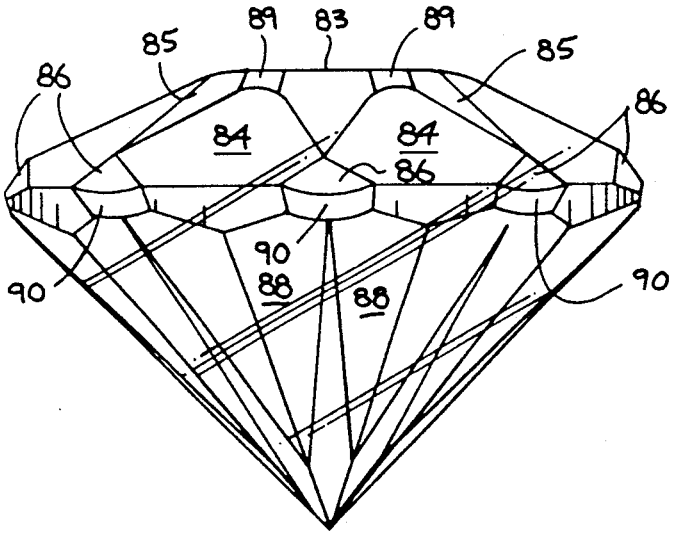
FIG. 20 is a side view.

FIGS. 13–27 and 29–31 illustrate exemplary gems having optically magnified facets formed on their exteriors as described above. In FIGS. 13–18 and 22–27, the facets are concave curved surfaces that are sections of cylinders. In FIGS. 19–21, they are convex curved surfaces.

A multitude of differing facet patterns can be produced about a gem by use of the above-described apparatus and method. The patterns shown in the accompanying drawings merely illustrate some of the basic options available.

Figure 13:
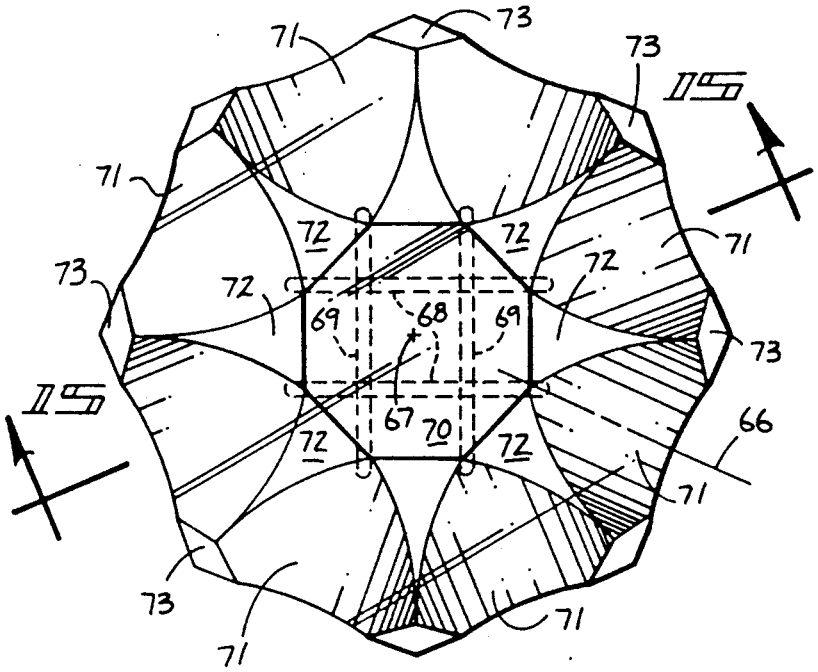
FIG. 13 is a top view of a brilliant cut gem having concave facet surfaces about its crown.
Figure 14:
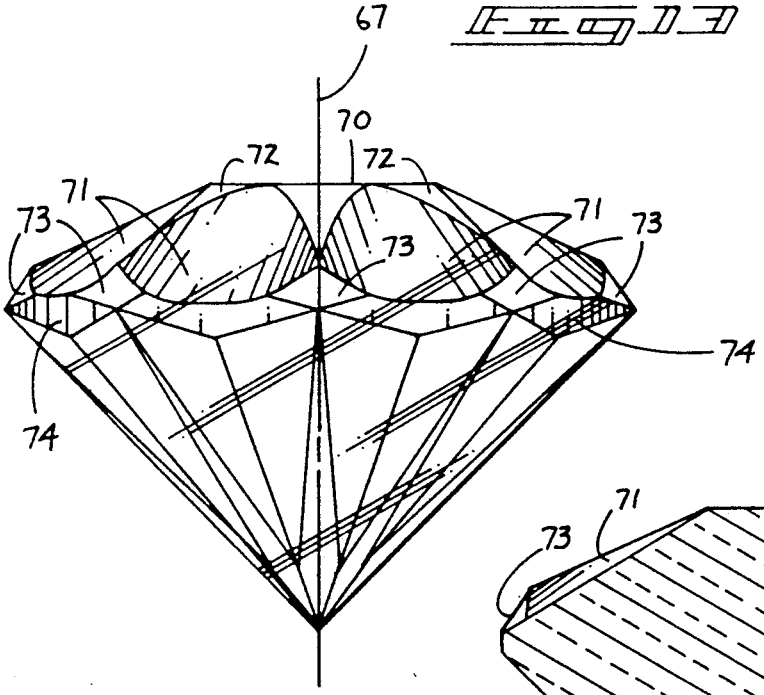
FIG. 14 is a side view.
Figure 15:
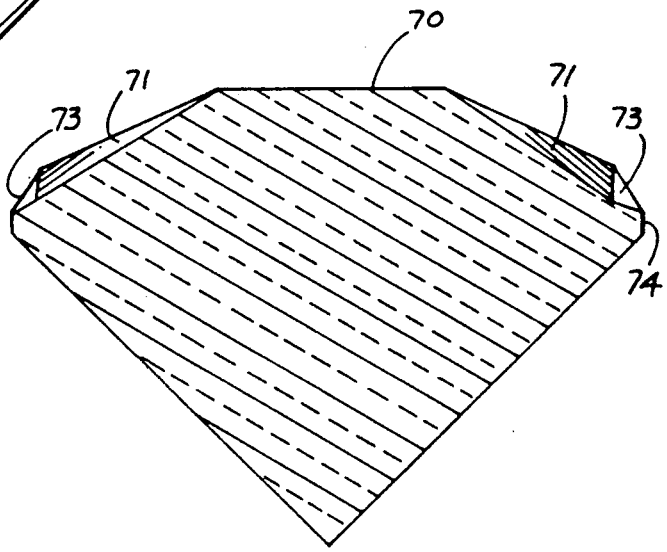
FIG. 15 is a sectional view taken along line 15—15 in FIG. 13.
Figure 16:
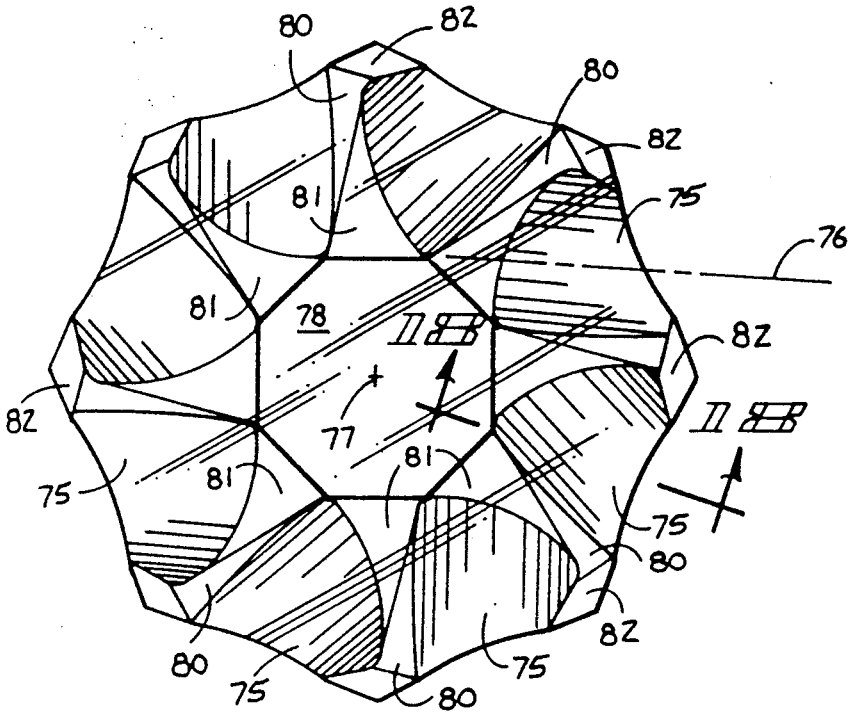
FIG. 16 is a top view of a brilliant cut gem having angularly offset concave facet surfaces about its crown.
Figure 17:
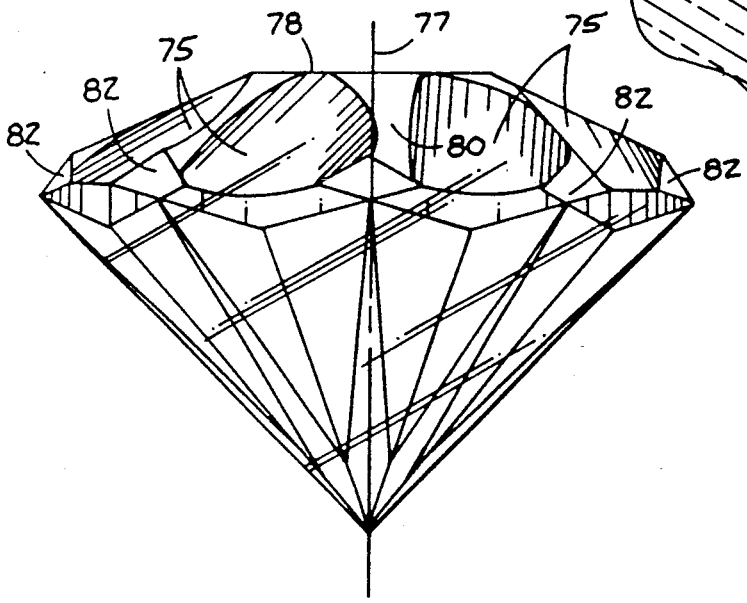
FIG. 17 is a side view.
Figure 29:
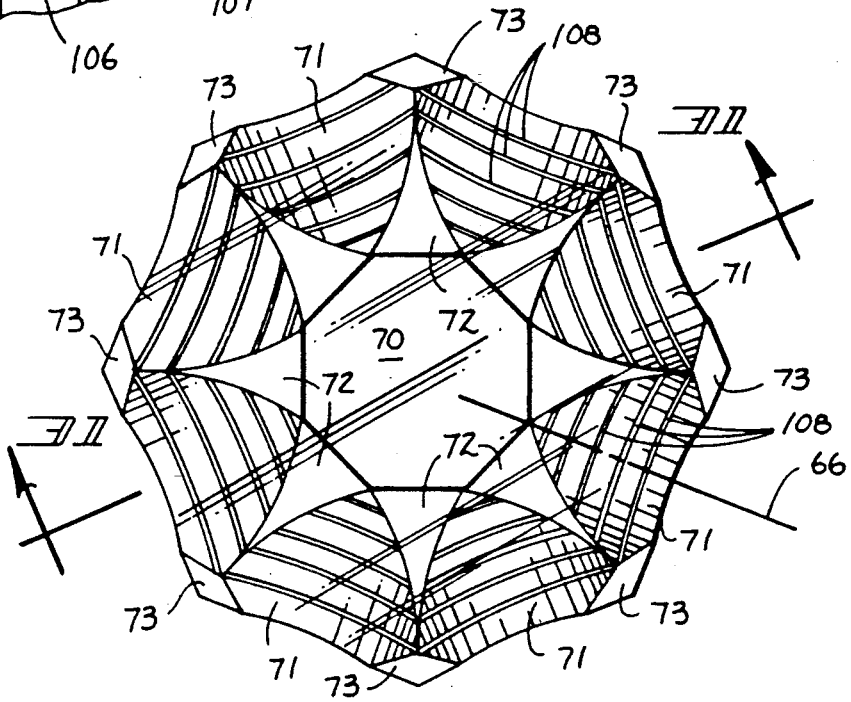
FIG. 29 is a top view of a brilliant cut gem having grooved facets extending across concave facet surfaces.
Figure 30:
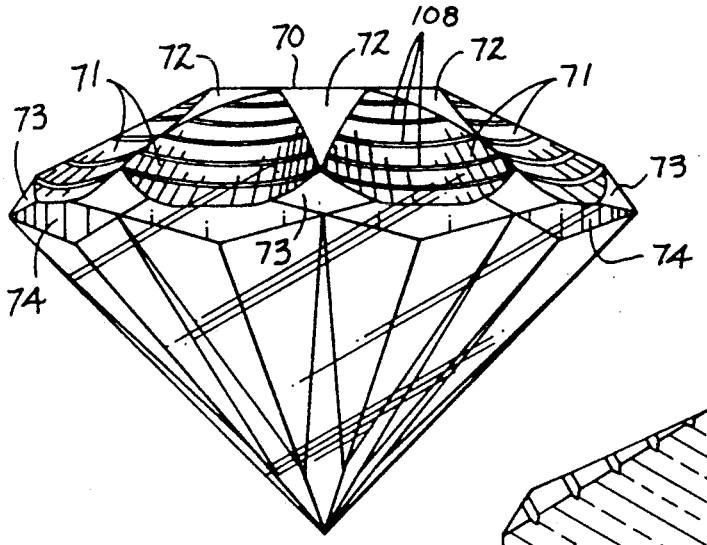
FIG. 30 is a side view.
Figure 31:
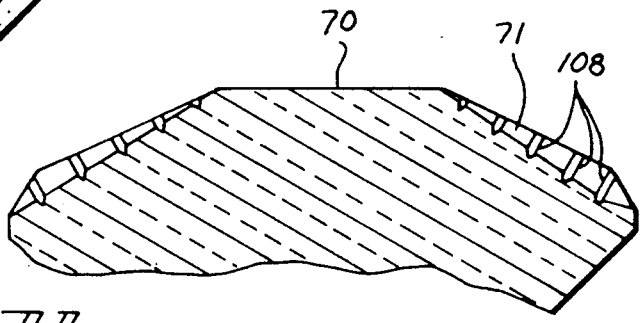
FIG. 31 is a sectional view taken along line 31—31 in FIG. 29.

When desired, the optically magnified facets can be arranged symmetrically about a central gem axis (FIGS. 13–15). In nonsymmetrical gems patterns (FIGS. 22–24), the facets can be formed with axes parallel to one another or intersecting one another or both (FIGS. 22–27). In the case of concave facet surfaces, the cylinder axes of the individual facets can be angularly offset from the gem axis to produce unique visual effects. In a symmetrical gem, the angular displacement of each cylinder axis can be identical about the gem to produce a helical facet pattern arranged about the gem axis (FIGS. 16–18). In addition, grooved facet surfaces can be formed across the planar table of a gem (FIGS. 25–27) or across any curved facet surface (FIGS. 29–31).

FIGS. 13–15 illustrate modifications of a conventional brilliant cut gem. The crown of the gem includes a planar table 70. In place of the conventional main facets in this well-known cut, there are provided optically magnified facets 71 arranged symmetrically about the gem axis. Each facet 71 intersects a conventional star facet 72 and a conventional girdle facet 73. The facets 72 and 73 are planar and not otherwise modified from normal practice. The gem is bordered by a girdle 74 and completed by a conventional pavilion leading to an apex coincident with the gem axis. In this symmetrical gem, the gem axis through the apex of the pavilion is perpendicular to the plane of table 70.

Each of the optically magnified facets 71 is in the form of a concave surface that is a section of a cylinder. The cylinder axis of each curved surface (illustrated by line 66) intersects the central gem axis (illustrated by line 67). To produce this pattern of optically magnified facets, it is preferably to first cut and polish the main facets on the gem on a flat lap (not shown) by conventional methods. The concave facet surfaces can then be formed across the areas of the main facets to enhance the brilliance and visual effects of the gem.

FIGS. 16–18 illustrate a variation of the gem design shown in FIGS. 13–15. In this variation, the modified main facets of the brilliant cut gem contain concave surfaces 75 that are again a section of a cylinder. However, in this arrangement, each cylinder axis (illustrated by line 76) is angularly offset and displaced from the gem axis (illustrated by line 77). In the symmetrical gem shown in these drawings, the cylindrical axes of the concave surfaces 75 will be identically offset and displaced from the gem axis.

The unmodified portions of the main facets in this cut are shown at 80. The concave cylindrical facet surfaces 75 also intersect the conventional star facets 81 and girdle facets 82 formed about the crown of this gem.

The pattern shown in FIGS. 16–18 is particularly unique in that the gem, when viewed from the top, presents a helical reflective pattern of optically magnified facets that appears to be spirally wound about the center of the gem.

FIGS. 19–21 illustrate gem modifications achievable by adding convex facets to a conventional brilliant cut gem. The formation of convex facets on the interior cylindrical surfaces of a moving mandrel is physically limited to rounding of points or corners on a conventional faceted gem. The illustrated gem includes a conventional table 83, main facets 84, star facets 85 and girdle facets 86. Small convex facets 89 can be formed at the intersection of each main facet 84 and two adjacent star facets 85. This can be accomplished after formation of the conventional facet pattern about the crown of the gem. Similarly, the intersections between the main facets 87 and girdle facets 86 in the crown of the gem and the girdle facets 88 in its pavilion can be rounded to produce cylindrical facets 90 about the girdle of the gem.

In a four sided gem (not shown), the intersecting corners about the gem can also be rounded to present convex optically magnified facets about the sides of the gem.

Figure 22:
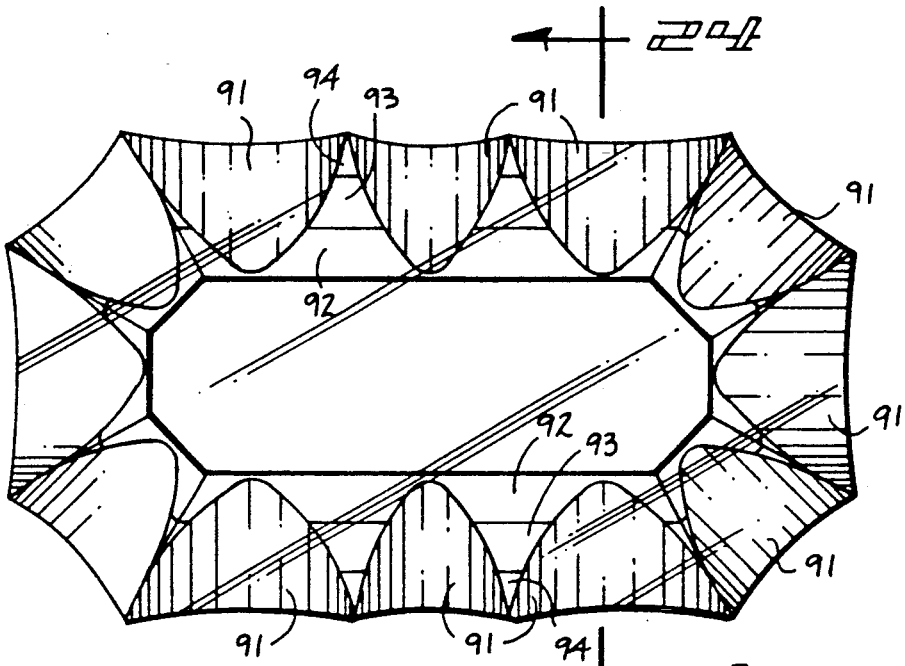
FIG. 22 is a top view of an emerald cut gem having concave facet surfaces about its crown.
Figure 24:
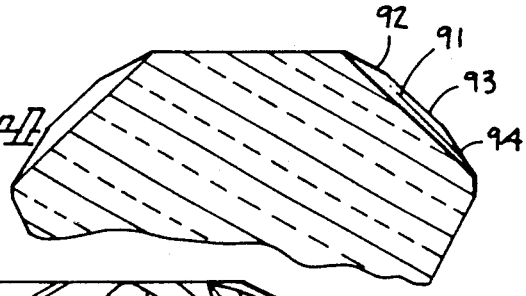
FIG. 24 is a sectional view taken along line 24—24 in FIG. 22.
Figure 23:
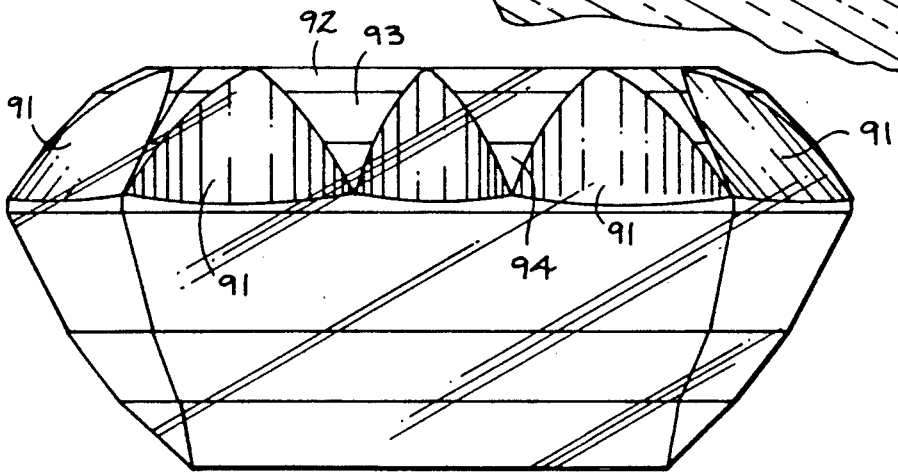
FIG. 23 is a side view.

FIGS. 22–24 illustrate optically magnified facets in the form of concave facet surfaces 91 arranged across the table facet 92, main facet 93 and girdle facet 94 on an emerald cut gem. In the illustrated modification, the three curved facets 91 at each side of the emerald cut have parallel cylinder axes. The three parallel facets can be formed with identical cylindrical surface diameters and lateral widths across the gem or with varying diameters and widths. In FIGS. 22 and 23 the diameter and width of the center curved facet along each side of the gem are less than those of the two curved facets at each of its sides. The three concave facets 91 across each end of the gem have cylinder axes that intersect at common points along the midline of the elongated gem.

Figure 25:
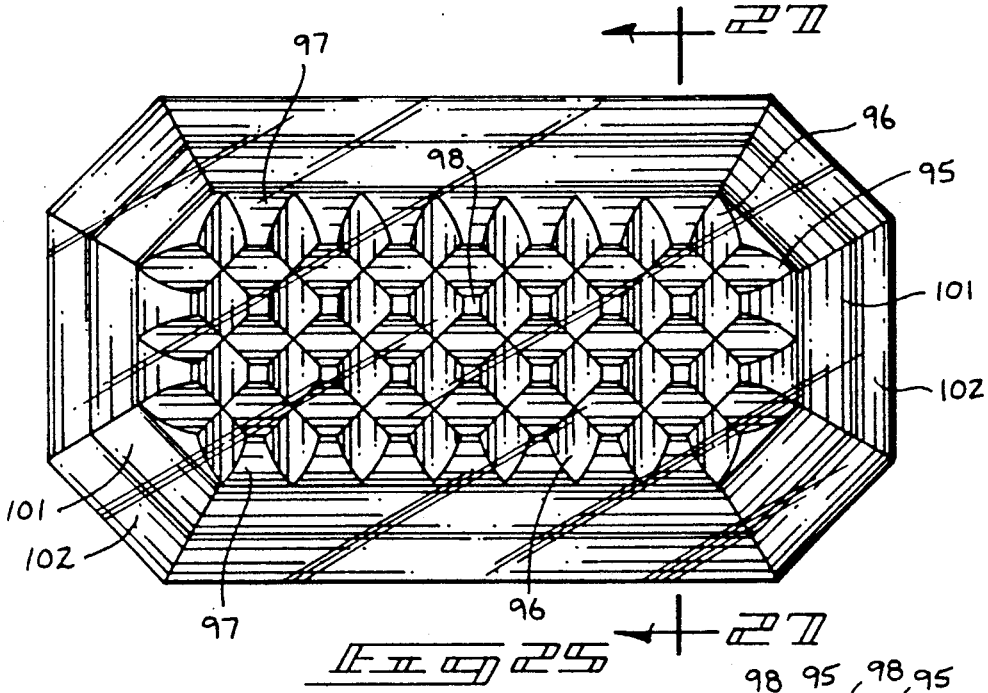
FIG. 25 is a top view of an emerald cut gem having concave facet surfaces about its table.
Figure 27:
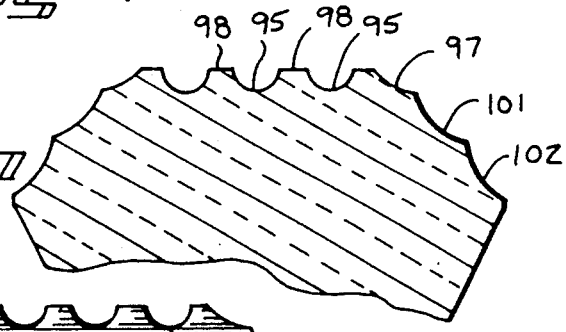
FIG. 27 is a sectional view taken along line 27—27 in FIG. 25.
Figure 26:
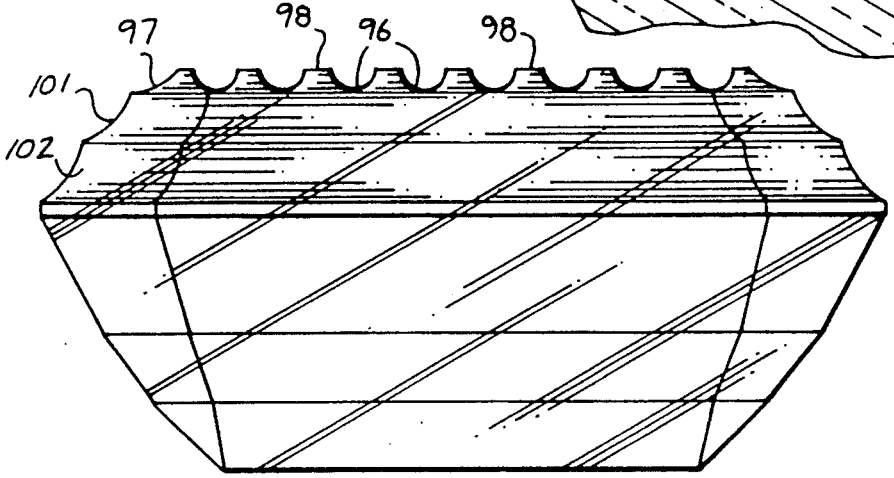
FIG. 26 is a side view.

FIGS. 25–27 illustrate an intersecting array of longitudinal concave cylindrical facets 95 and transverse concave cylindrical facets 96 formed across the table 98 and table facets 97 on an emerald cut gem. The resulting "checkerboard" pattern of optically magnified facets across the table 98 will appear to visually stand out from the gem and produces unique light reflections and refractions in addition to the usual appearance of such a gem. It can be produced across a planar surface, rather than across a surface that is convex in two directions, as is necessary when using planar faceting techniques for such patterns. To add concave facets across the table of a gem, the table must be brought into contact with a small-diameter mandrel (not shown) in the desired geometric relationship to cut and polish a cylindrical grooved facet where desired about the table. It is also possible to add a similar "tic-tac-toe" pattern across the planar table of a gem, as illustrated by the concave curved facets 68 and 69 shown in dashed lines in FIG. 13. Such optical embellishment is impossible to produce by use of a flat lap without first producing a crowned table on a gem.

FIGS. 25–27 also illustrate production of elongated curved facets along each of the table facets 97, main facets 101 and girdle facets 102 on an emerald cut gem. The cylinder axis of each concave cylindrical surface forming the facets extends parallel to the facet length.

Many additional variations of these gems will present themselves to the artisan once familiar with the method and apparatus by which one can practically form concave and convex gem surfaces about the crown, girdle and pavilion of a gem. This disclosure is not to be limited to the illustrated gem patterns, which simply show several variations of conventional facet patterns that can be achieved by the addition of cylindrically curved facets.

The radius of each cylindrical surface can be varied to meet requirements of a particular gem. This can be accomplished by interchanging mandrels of different diameters to vary the cylindrical radius of a selected curved surface being cut and polished.

Figure 28:
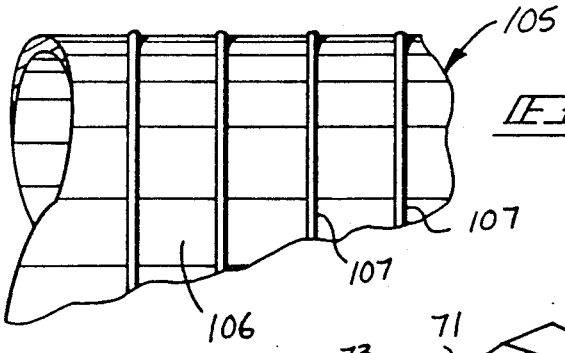
FIG. 28 is a fragmentary view of a modified mandrel.

FIGS. 29–31 illustrate results that can be achieved by utilizing a modified mandrel 105, a portion of which is enlarged and illustrated in FIG. 28. Mandrel 105 is usable in conjunction with the apparatus shown in FIGS. 1–4 and 6–10, where separate controls are provided for angularly moving the mandrel about the mandrel axis and for reciprocating it along the mandrel axis. When using the mandrel 105, no reciprocating motion is imparted to the mandrel.

The mandrel 105 is a polishing mandrel for use after a cylindrically curved facet surface has been cut about a gem by a cutting mandrel (not shown) of the same diameter. The polishing mandrel 105 has an abrasive surface 106 interrupted by a series of protruding axially spaced circumferential ridges 107. Each ridge 107 is arranged along a direction perpendicular to the mandrel axis.

The cross sectional configuration of the ridges 107 can be any desired shape. It can be arcuate, semicircular, V-shaped, square, or can have the profile of a machined thread or gear. On a typical cylindrical mandrel 106 having a diameter of approximately 1½ inches, the ridges 107 might have a height of 0.005–0.020 inches and be spaced center-to-center along the axial length of the mandrel by a distance of 0.010–0.050 inches. These dimensions are merely illustrative. The exact measurements will be dependent upon the size of the gem and facets to be engaged by the particular mandrel.

FIGS. 29–31 illustrate a variation of the gem previously described with respect to FIGS. 13–15. The only modification of the illustrated gem relates to the addition of the axially spaced grooved facets 108 that extend across the curved surfaces of the optically magnified facets previously described. All of the remaining components of the gem are indicated by the same reference numerals used in conjunction with FIGS. 13–15.

The grooved facets 108 extend across the curved surfaces of the optically magnified facets in a direction perpendicular to their cylinder axes (illustrated by line 66). The grooved facets are produced by rotation of the polishing mandrel 105. The protruding ridges 107 rotating about mandrel 105 will cut and polish the surfaces of the grooved facets 108 as the curved surfaces of the facets 71 are being polished by contact with mandrel 105. If desired, a separate polishing mandrel (not shown) having a continuous cylindrical polishing surface of the same diameter as mandrel 105 can be used with dual mandrel movement to further polish the curved surface areas of facets 71 between the grooved facets 108.

The resulting grooved facets 108 increase the scintillations visible in a gem by providing multiple small optical surfaces about the larger curved optical surfaces in which they are formed.

Axial grooved facets (not shown) can also be formed along the optically magnified facets by polishing them against a modified mandrel (not shown) having axial ridges in place of the circumferential ridges 107 shown in FIG. 28. In this instance, the polishing action of the mandrel would be limited to reciprocation parallel to the mandrel axis, and no angular movement would be imparted to the mandrel during formation of the grooved facets. Alternately, helical grooved facets can be produced by a modified mandrel (not shown) having helical ridges formed about it that are complimentary to the helical path of movement imparted to the mandrel by a combination of angular movement and axial reciprocation, as described with respect to the invention embodiment in FIGS. 11 and 12.

While the grooved facets have been illustrated and described with respect to their application to concave facet surfaces, they can also be provided about convex facet surfaces of the type shown in FIGS. 19–21. To produce the grooved facets on a concave surface, an inside cylindrical polishing surface on a mandrel would be modified by the addition of protruding ridges in the patterns previously described.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. A gem faceting apparatus for producing optically magnified facets about a gem, wherein each such facet is formed as a curved surface that is a section of a cylinder, comprising:

a base;

a mandrel having a cylindrical abrasive surface centered along a mandrel axis, the mandrel being movably supported on the base for both angular and axial motion with respect to the mandrel axis;

drive means operatively connected to the mandrel for angularly moving the mandrel about the mandrel axis and axially reciprocating the mandrel parallel to the mandrel axis; and gem holding means on the base for supporting a gem in contact with the cylindrical abrasive surface of the moving mandrel.

2. The gem faceting apparatus of claim 1, further comprising:

adjustable support means operably connected between the base and the mandrel for angularly positioning the mandrel axis relative to the base.

3. The gem faceting apparatus of claim 1, wherein the drive means continuously rotates the mandrel about the mandrel axis.

4. A gem faceting apparatus for producing optically magnified facets about a gem, wherein each such facet is formed as a curved surface that is a section of a cylinder, comprising:

a base;

a mandrel movably supported on the base, the mandrel having a cylindrical abrasive surface centered along a mandrel axis;

drive means operatively connected to the mandrel for angularly moving the mandrel about the mandrel axis to continuously oscillate the mandrel about the mandrel axis; and gem holding means on the base for supporting a gem in contact with the cylindrical abrasive surface of the moving mandrel.

5. The gem faceting apparatus of claim 1, wherein the gem holding means includes a dop adapted to be fixed to a gem being faceted, and further comprising:

universally adjustable stabilizing means on the base for engaging a dop for maintaining the dop in a preset stationary position relative to the base.

6. The gem faceting apparatus of claim 1, wherein the drive means comprises separate motors operably connected to the mandrel for angularly moving and reciprocating the mandrel, respectively.

7. A gem faceting apparatus for producing optically magnified facets about a gem, wherein all or part of each facet is formed as a curved surface that is a section of a cylinder, comprising:

a base;

a mandrel movably supported on the base, the mandrel having a cylindrical abrasive surface formed about a central mandrel axis; and drive means operatively connected to the mandrel for angularly moving the mandrel about the mandrel axis and axially reciprocating it parallel to the mandrel axis; and gem holding means on the base for supporting a gem in contact with the cylindrical abrasive surface of the moving mandrel;

the drive means comprising:

a linear actuator operably connected to the mandrel for reciprocating the mandrel along to the mandrel axis; and means operably connected between the base and the mandrel for imparting oscillating movement to it about the mandrel axis in response to the reciprocating motion.

8. The gem faceting apparatus of claim 1, wherein the abrasive surface is an exterior cylindrical surface centered about the mandrel axis.

9. The gem faceting apparatus of claim 1, wherein the abrasive surface is an interior cylindrical surface centered about the mandrel axis.

10. A gem faceting apparatus for producing optically magnified facets about a gem, wherein all or part of each facet is formed as a curved surface that is a section of a cylinder, comprising:

a base;

a mandrel movably supported on the base, the mandrel having a cylindrical abrasive surface formed about a central mandrel axis; and drive means operatively connected to the mandrel for angularly moving the mandrel about the mandrel axis and axially reciprocating it parallel to the mandrel axis; and gem holding means on the base for supporting a gem in contact with the cylindrical abrasive surface of the moving mandrel;

the abrasive surface being an axial section of a cylindrical surface centered about the mandrel axis.

11. A gem faceting apparatus for producing optically magnified facets about a gem, wherein each such facet is formed as a curved surface that is a section of a cylinder, comprising:

a base;

a mandrel having a cylindrical abrasive surface centered along a mandrel axis, the mandrel being movably mounted to the base for both angular and axial motion with reference to the mandrel axis; and drive means operatively connected to the mandrel for angularly moving the mandrel about the mandrel axis and reciprocating the mandrel parallel to the mandrel axis; and adjustable support means operably connected between the base and the mandrel for angularly positioning the mandrel axis relative to the base about two perpendicular axes.

12. A gem faceting apparatus for producing optically magnified facets about a gem, wherein each such facet is formed as a curved surface that is a section of a cylinder, comprising:

a base;

a mandrel having a cylindrical abrasive surface centered along a mandrel axis, the mandrel being movably mounted to the base for both angular and axial motion with reference to the mandrel axis; and drive means operatively connected to the mandrel for angularly moving the mandrel about the mandrel axis and reciprocating the mandrel parallel to the mandrel axis;

adjustable support means operably connected between the base and the mandrel for angularly positioning the mandrel axis relative to the base about two perpendicular axes, the adjustable support means also mounting the mandrel for translational movement across the base; and locking means for selectively fixing the angular and translational positions of the mandrel relative to the base.

13. A gem faceting apparatus for producing optically magnified facets about a gem, wherein each such facet is formed as a curved surface that is a section of a cylinder, comprising:

a base;

a mandrel having a cylindrical abrasive surface centered along a mandrel axis, the mandrel being movably mounted to the base for both angular and axial motion with reference to the mandrel axis; and drive means operatively connected to the mandrel for angularly moving the mandrel about the mandrel axis and reciprocating the mandrel parallel to the mandrel axis; and connection means for adjustably positioning a gem support apparatus for translational movement along the base.

14. A gem faceting apparatus for producing optically magnified facets about a gem, wherein each such facet is formed as a curved surface that is a section of a cylinder, comprising:

a base;

a mandrel having a cylindrical abrasive surface centered along a mandrel axis, the mandrel being movably mounted to the base for both angular and axial motion with reference to the mandrel axis; and drive means operatively connected to the mandrel for angularly moving the mandrel about the mandrel axis and reciprocating the mandrel parallel to the mandrel axis;

support means operably connected between the base and the mandrel; and a shroud mounted to the support means and partially overlapping the mandrel to minimize splashing of fluids and particles from the abrasive mandrel surface.

15. A gem faceting apparatus for producing optically magnified facets about a gem, wherein each such facet is formed as a curved surface that is a section of a cylinder, comprising:

a base;

a mandrel having a cylindrical abrasive surface centered along a mandrel axis, the mandrel being movably mounted to the base for both angular and axial motion with reference to the mandrel axis; and drive means operatively connected to the mandrel for angularly moving the mandrel about the mandrel axis and reciprocating the mandrel parallel to the mandrel axis;

support means operably connected between the base and the mandrel; and universally adjustable stabilizing means mounted to the support means adapted to engage a gem supporting member for maintaining the gem in a preset stationary position relative to the base.

* * * * *